US006997174B2

(12) United States Patent
Sandberg

(10) Patent No.: US 6,997,174 B2
(45) Date of Patent: Feb. 14, 2006

(54) BOW STABILIZER

(76) Inventor: Blair A. Sandberg, 514 E. San Luis Dr., Santa Maria, CA (US) 93455

( * ) Notice: Subject to any disclaimer, the term of this patent is extended or adjusted under 35 U.S.C. 154(b) by 0 days.

(21) Appl. No.: 10/623,430

(22) Filed: Jul. 18, 2003

(65) Prior Publication Data

US 2005/0011509 A1 Jan. 20, 2005

(51) Int. Cl.
*F41B 5/20* (2006.01)

(52) U.S. Cl. ..... 124/89

(58) Field of Classification Search ..... 124/89
See application file for complete search history.

(56) References Cited

U.S. PATENT DOCUMENTS 4,660,538 A * 4/1987 Burgard ..... 124/89
4,936,283 A * 6/1990 Izuta ..... 124/89
5,273,022 A * 12/1993 Leven ..... 124/89
5,390,656 A * 2/1995 Villa et al. ..... 124/89
5,460,156 A * 10/1995 Sappington ..... 124/89
5,584,282 A * 12/1996 McDonald, Jr. ..... 124/89
5,617,664 A * 4/1997 Troncoso ..... 42/1.06
5,904,134 A * 5/1999 Denbow ..... 124/89
6,085,736 A * 7/2000 Osterhues ..... 124/89

* cited by examiner

*Primary Examiner*—John A. Ricci
(74) *Attorney, Agent, or Firm*—Law Offices of David L. Hoffman

(57) ABSTRACT

In one embodiment, a bow stabilizer for an archery bow has an elongated member having a near end for attachment to an archery bow and a distal end, the elongated member having a length L, and a weight attached to the elongated member proximate the distal end. The center of gravity of the elongated member and weight is located within 25 percent of length L from the distal end of the elongated member. In another embodiment, the stabilizer has an elongated member having a near end for attachment to an archery bow, a distal end, and a weight attached to the elongated member proximate the distal end. The natural frequency of the first bending mode of the elongated member and weight is at least 20 Hz. In a further embodiment, the stabilizer has an elongated member having a near end for attachment to an archery bow and a distal end, and a weight attached to the elongated member proximate the distal end. The weight has a first mass M1 which is at least 1.2 times a second mass M2 of the elongated member.

25 Claims, 3 Drawing Sheets

BOW STABILIZER

BACKGROUND OF THE INVENTION

A major source of inaccuracy when shooting an arrow with a bow is the instability of the bow position as it is held by the archer. In the prior art, there are numerous examples of devices intended to mitigate this instability. Examples include U.S. Pat. No. 3,196,860 (Hoyt), U.S. Pat. No. 3,752,142 (Morita), U.S. Pat. No. 3,804,072 (Izuta), U.S. Pat. No. 4,054,121(Hoyt), and U.S. Pat. No. 4,982,719 (Haggard). As a specific case, Hoyt (U.S. Pat. No. 3,196,860) describes a device having rods with weighting elements with the rods mounted in various orientations on the bow. Morita, Izuta, and Hoyt (U.S. Pat. No. 4,054,121) further describe similar devices with various orientations of the rods and weights. There are also devices similar to that described by Haggard which incorporate a flexible element. Such flexible elements ostensibly serve the purpose of absorbing vibrations.

The present inventor has recognized many fundamental issues that must be addressed to obtain high performance from a stabilizing device. Those issues are:

a). Stabilization of the bow is best achieved by maximizing the rotational inertia afforded by the stabilizing device.

b). The rotational inertia of the stabilizing device may be increased both by lengthening the device and increasing its mass.

c). For the given inertia provided by the stabilizer, that mass must be minimized in order to minimize the load supported by the archer.

d). Practical considerations such as ease of use and transportation or the rules of competitive archery limit the allowable length of the stabilizing device. Within such length limitations, the inertia of the stabilizer must be maximized in order to provide the best performance.

e). In order to best stabilize the bow, and especially at the moment the arrow is released, the stabilizer must be rigidly coupled to the bow.

FIELD OF THE INVENTION

This invention relates to the stabilization of an archery bow prior to and during the release of the arrow.

SUMMARY OF THE INVENTION

Accordingly, in one embodiment of the present invention a stabilizing device for an archery bow provides the maximum inertia for a given mass, thereby stabilizing the bow against motions imparted by the archer or any other external forces.

In a preferred embodiment of the present invention, the maximum inertia for a given length of the stabilizing device is provided such that the device conforms to the practical constraints of convenient use or competitive archery.

Also in a preferred embodiment of the present invention, the stabilizing device is rigidly coupled to the bow so that the attendant inertia acts to stabilize all motions, not only for long duration transient motions or low frequency vibrations as is the case when the device is flexibly coupled.

Such preferred embodiments of the present invention have a stabilizing device comprising a relatively lightweight rod or rods with the maximum allowable length(s). Such rod or rods are rigidly attached to the bow, each with a stabilizing mass at the distal end. Further, the mass is to be shaped so as to concentrate as much of the mass as practical at the furthest distal portion of the rod.

The nature, principle, and utility of the invention will be more clearly understood from the following detailed description when read in conjunction with the accompanying drawings.

DESCRIPTION OF THE PREFERRED EMBODIMENT(S)

Figure 1:
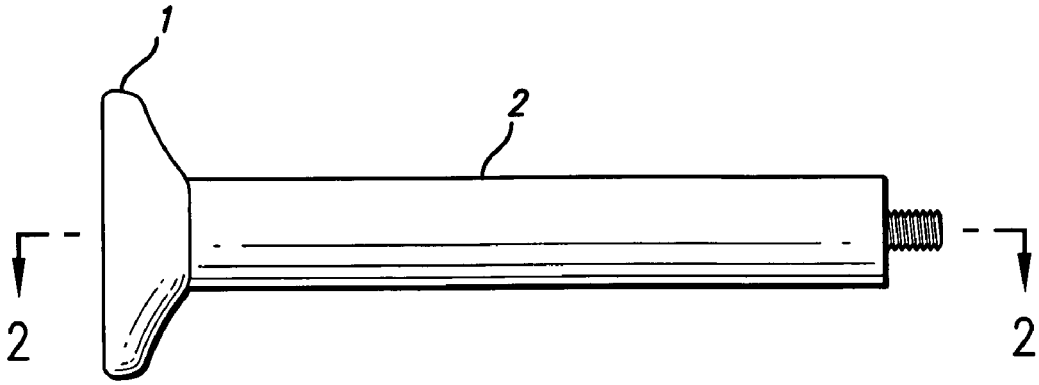
FIG. 1 is a side view of a preferred embodiment in accordance with the present invention.

FIG. 1 shows a preferred embodiment of the invention in which stabilizing weight 1 is attached to supporting rod 2. The stabilizing mass is shown with a shape that tends to concentrate its mass at the end of the supporting rod. As shown in FIG. 1, this means that the dimension of the mass in the direction along the length of the supporting rod is short compared to a dimension of the mass transverse to that length. In this specific case, the mass is shown as a disk whose dimension along the length of the rod, or thickness, is approximately one fifth its dimension transverse to the rod length, or diameter. Weight 1 may be attached to supporting rod 2 using a variety of common methods. These methods include the use of a threaded connection with an internal thread in weight 1 and an external thread on the distal end of supporting rod 2, a screw connection with a screw passing through weight 1 and threading into supporting rod 2, and other methods such as welding or bonding.

As a specific example, weight 1 could be a uniform disk with a thickness of 0.5 inches, a diameter of 2.75 inches and be made of stainless steel. The supporting rod 2 could be a hollow tube with an outside diameter of 0.875 inches and an inside diameter of 0.78 inches, a length of 11.5 inches and be made of aluminum alloy. In this case, the combination of weight 1 and supporting rod 2 would have a weight of about 16 ounces. The center of mass of the combination would lie on the centerline of rod 2, about 1.08 inches from the distal end of the stabilizer.

As another example, weight 1 could be a uniform disk with a thickness of 0.209 inches, a diameter of 2.75 inches and be made of tungsten. The supporting rod 2 could again have an outside diameter of 0.875 inches, and inside diameter of 0.78 inches but with a length of 11.791 inches so that the overall length is still 12 inches. In this case, weight of the combination would again be about 16 ounces and the center of mass would lie about 0.998 inches from the distal end of the stabilizer.

Figure 2:
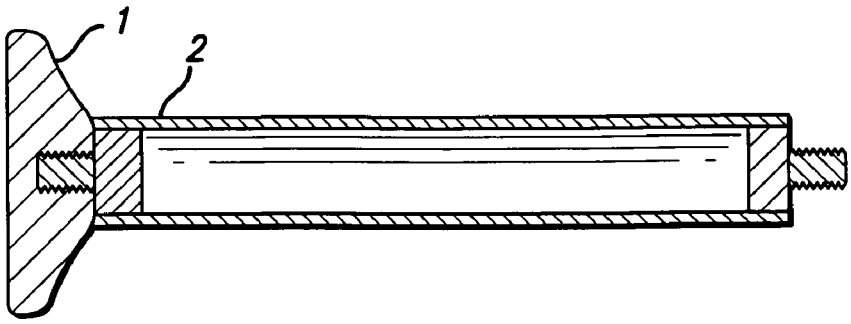
FIG. 2 is a cross-sectional view taken along line A—A in FIG. 1.
Figure 6:
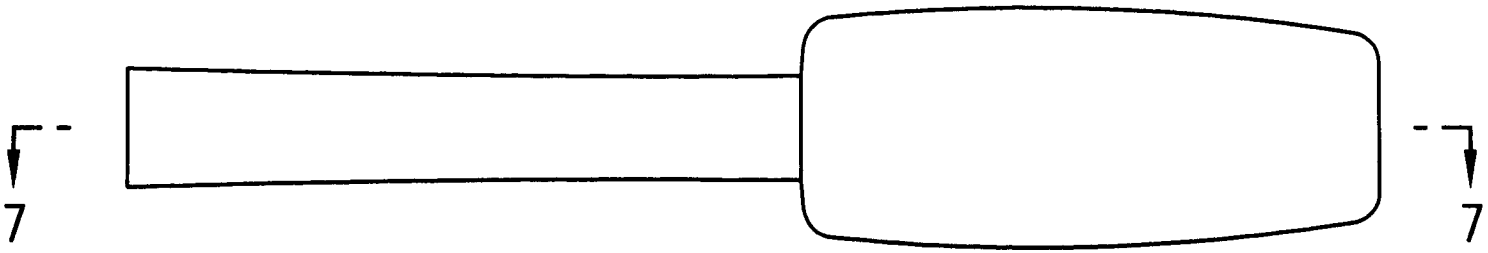
FIG. 6 is a side view of an alternative stabilizer configuration with a cylindrical weight.
Figure 7:
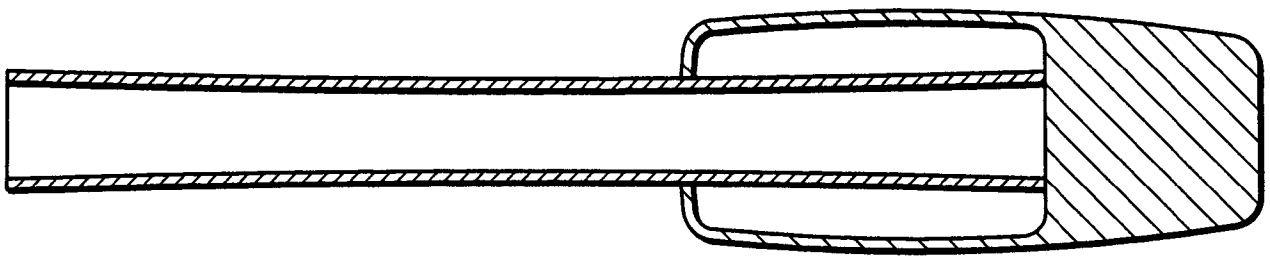
FIG. 7 is a cross-sectional view taken along line C—C in FIG. 6 showing the hollow nature of the cylindrical weight.

It is possible for weight 1 to have alternative shapes from that shown in FIG. 1 and FIG. 2 and still achieve the purpose of concentrating the mass at the distal end of the rod. For example, FIG. 6 shows a configuration in which the outer shape of weight 8 is substantially a cylinder with its length larger than its diameter. FIG. 7 shows, however, that weight 8 contains a cavity and that the preponderance of the mass is still concentrated at the distal end of the stabilizer device.

In FIG. 2, the supporting rod 2 is shown in cross-section as a substantially hollow structure. This serves to maximize the stiffness of the supporting rod for a given amount of mass in the rod. For the purposes of illustration, we may consider some specific cases. In one instance, the supporting rod 2 is substantially a round aluminum tube with an outer diameter of 0.875 inches, an inner diameter of 0.78 inches and an overall length of 11.5 inches. In this case, the tube would have a weight of about 2.2 ounces. If weight 1 had a weight of 13.8 ounces and this were applied to one end of such a tube while the other end of the tube were held fixed, the tube would deflect approximately 0.005 inches. Additionally, the structure would have a natural frequency in its first bending mode of about 47 Hz.

This can be compared to a case in which the mass of the hollow aluminum tube is used to make a solid rod with the same length as above. This would result in a rod with a diameter of about 0.4 inches. In this case, if a 13.8 ounce weight were applied to the end of the rod, it would deflect approximately 0.042 inches. The natural frequency of the first bending mode would be about 14 Hz.

For the purposes of this invention, the solid rod above would not be considered rigid. This is because the inertia of the stabilizer is effective in minimizing motions only for disturbances with a duration greater than about half the period of the first natural frequency. This is due to the fact that for long duration disturbances, the stabilizer and the bow move as a unit, effectively coupling the inertia of the stabilizer to the bow. For short duration disturbances, the inertia of the stabilizer is effectively decoupled from the bow as the flexibility of the stabilizer allows the bow to move while the mass of the stabilizer remains relatively stationary. To consider a practical example, when an arrow is released, the time required for the arrow to just leave the bow can be as short as $1/50^{th}$ of a second. If the natural frequency of the stabilizer were 14 Hz, it would be relatively ineffective in mitigating the bow's reaction to the release of the arrow since the $1/50^{th}$ of a second duration of the disturbance is shorter than one-half the period of the 14 Hz frequency, or $1/28^{th}$ of a second.

In contrast, the configuration incorporating the hollow tube previously described would be relatively effective in mitigating this disturbance. This is because the $1/50^{th}$ of a second duration of the disturbance is longer than one-half the period of the first natural frequency of 47 Hz which is $1/94^{th}$ of a second in this case.

As the stabilizer becomes more flexible and the natural frequency decreases, the stabilizer becomes effective only against disturbances with still longer durations. A stabilizer with a natural frequency as low as 30 Hz is still of practical use in mitigating disturbances introduced during the release of an arrow. Such a stabilizer is also effective against slower disturbances as might be introduced by the archer's heartbeat or the unsteadiness of the hand that supports the bow. Stabilizers incorporating purposely flexible elements can have natural frequency of 1 Hz or lower. The minimum disturbance duration for which such a stabilizer is effective is accordingly about ½ second or longer. Such stabilizers are practically ineffective against the relatively fast disturbances caused by a heartbeat or arrow release.

Figure 3:
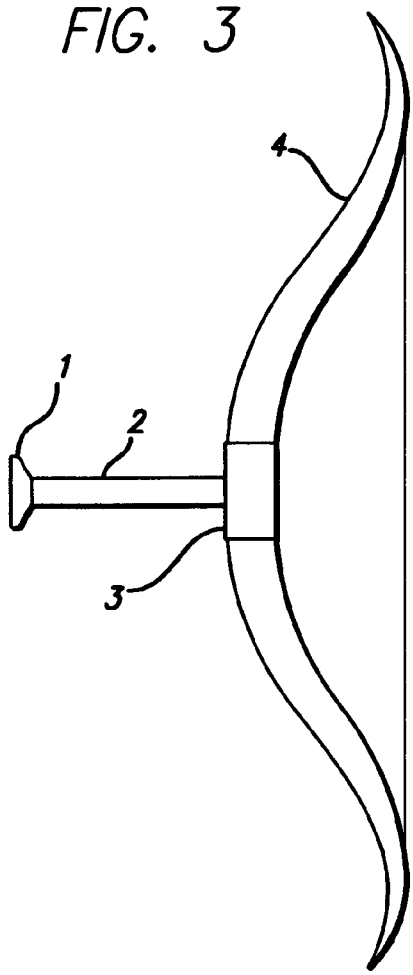
FIG. 3 is a side view of a preferred embodiment of the present invention when attached to an archery bow in one possible configuration.

FIG. 3 shows one instance of the preferred embodiment of the stabilizer where it is attached near the grip portion 3 of an archery bow 4 and extending in the forward direction. The mass of the stabilizer serves to substantially increase the rotational inertia of the bow-stabilizer combination about any axis transverse to the stabilizer rod. It is this increase in inertia that acts to stabilize the bow and make it more resistant to motions imparted by the archer or by other forces.

Further in FIG. 3, it is foreseen that the combined length of weight 1 and supporting rod 2 is just what is allowed by some practical limitation. For example, the National Field Archery Association's rules governing the Competitive Bowhunter class of competition permit the use of a single stabilizer whose length may not exceed 12 inches. Taking this to be the case illustrated in FIG. 3, it is clearly seen that the stabilizing weight 1 is concentrated as far as practical at the distal end of the supporting rod 2. This configuration functions to maximize the rotational inertia of the bow-stabilizer combination for the given mass.

To concretely illustrate this effect, we may first consider weight 1 to be made of tungsten in the configuration previously described, and supporting rod 2 to be the hollow aluminum tube also previously described. This results again in a combined weight of about 16 ounces, an overall length of the stabilizer of 12 inches, and a center of mass located about 0.995 inches from the distal end of the stabilizer. This in turn means that the center of mass of the combination is about 11.005 inches from the attachment point of the stabilizer to the bow and results in a moment of inertia for the stabilizer of $(11.005 \text{ inches})^2 \times (16 \text{ ounces}) = 1937.7$ ounce-inches$^2$ about the attachment point.

If instead, weight 1 retained the same mass but was shaped as a cylinder with a diameter of 0.875 inches rather than a disk with a diameter of 2.75 inches, and were made of steel, the length of the cylinder would be about 5.25 inches. Using the same type of hollow tube as before and maintaining the 12-inch overall length results in a center of mass located about 8.884 inches from the attachment point of the stabilizer to the bow. This results in a moment of inertia of 1262.8 ounce-inches$^2$ about the attachment point.

The difference in moments of inertia in the two cases just described is about 50%. This means that the disk-like configuration of weight 1 as in a preferred embodiment shown in FIG. 1 would be 50% more effective in mitigating disturbances than the cylindrical configuration just described. This is despite the fact that the mass of weight 1 and the overall length of the stabilizers are the same, providing a clear illustration of the importance of concentrating as much mass as possible at the distal end of the stabilizer.

Figure 4:
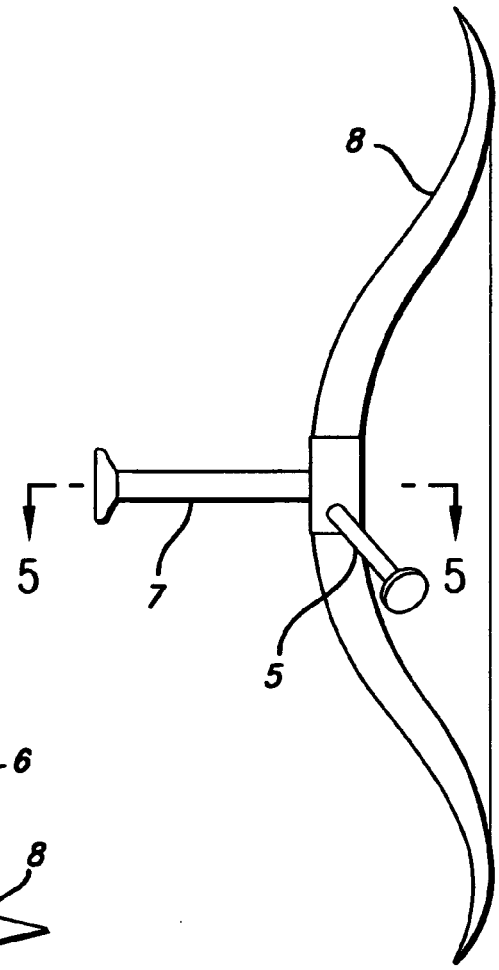
FIG. 4 is a side view of a preferred embodiment of the present invention when attached to an archery bow in an alternative configuration.
Figure 5:
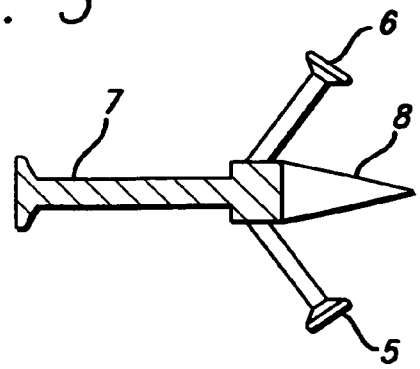
FIG. 5 is a cross-sectional taken along line B—B in FIG. 4.

In FIG. 4 and FIG. 5 an alternative embodiment is shown in which a multiplicity of stabilizing devices 5 and 6 are attached to bow 2 in addition to stabilizing device 7. Devices 5 and 6 are shown disposed primarily transversely and rearwardly to device 7. Such a configuration can afford improved stabilization of bow 4 by further increasing the rotational inertia of the bow-stabilizer combination.

It should be noted that further alternative configurations are possible while remaining within the scope of this invention. For example, supporting rod 2 may be substantially lengthened while keeping the mass of weight 1 concentrated at the distal end. This serves to increase the rotational inertia of the stabilizer for a given mass.

Another alternative could use different cross-sections for supporting rod 2 such as square, hexagonal, or that of an I-beam. The rod could also be fabricated from any of a variety or combination of materials such as any of the common metals, plastics, or composite materials of sufficient rigidity. The economic dictates of the practical situation would likely be the determining factor in the selection among such possibilities.

Weight 1 could also be fabricated from any of a variety or combination of materials with adequate material properties. These could include various steels, lead, brass, tungsten and its alloys, uranium, and other metallic and non-metallic materials. Again, it is most likely a sum of economic factors that would primarily influence such choices.

Note that one may achieve alternative embodiments of the invention by means of a solid rod of a lightweight material, a weight that is unitary with the rod, or fixed to the rod, and has a higher specific gravity relative to the rod material, yet is fashioned to look like the end of the rod, and other variations of the invention will be evident to those of ordinary skill in the art.

What is claimed is:

1. A stabilizer for an archery bow, the stabilizer comprising an elongated member having a near end for attachment to an archery bow and a distal end, the elongated member having a length L, and a weight attached to the elongated member proximate the distal end, wherein the center of gravity of the elongated member and weight is located within 25 percent of length L from the distal end of the elongated member, wherein the weight has a dimension D in a direction normal to the length L of the elongated member which is at least three times a thickness T of the weight in the same direction as the length of the elongated member.

2. The stabilizer of claim 1, wherein a first mass M1, of the weight is at least 1.2 times a second mass M2 of the elongated member.

3. The stabilizer of claim 1, wherein the weight is disk-shaped.

4. The stabilizer of claim 1, wherein the elongated member is a rod.

5. The stabilizer of claim 1, wherein the elongated member is a hollow rod.

6. The stabilizer of claim 1, wherein a natural frequency of the first bending mode of the elongated member and weight is at least 20 Hz.

7. An archery bow having at least one front stabilizer, the front stabilizer having a near end fixed to the bow, a distal free end, and a length L, the center of gravity of the front stabilizer being located within a distance D of of the distal end of the stabilizer, wherein the distance D is within 15 percent of the length L of the distal end of the stabilizer.

8. The archery bow of claim 7, wherein the stabilizer comprises an elongated member and a weight disposed on the elongated member proximate the distal end thereof.

9. The archery bow of the claim 8, wherein the elongated member is a rod and the weight has a disk shape.

10. The archery bow of claim 8, wherein the weight has a dimension D in a direction normal to a length L of the elongated member which is at least three times a thickness T of the weight in the same direction as the length of the elongated member.

11. The archery bow of claim 8, wherein a first mass M1, of the weight is at least 1.2 times a second mass M2 of the elongated member.

12. The archery bow of claim 8, wherein the elongated member is a rod.

13. The archery bow of claim 8, wherein the elongated member is a hollow rod.

14. The archery bow of claim 7, wherein a natural frequency of the first bending mode of the stabilizer is at least 20 Hz.

15. A bow stabilizer for an archery bow, the stabilizer comprising an elongated member having a near end for attachment to an archery bow and a distal end, the elongated member having a length L, and a weight attached to the elongated member proximate the distal end, wherein the center of gravity of the elongated member and weight is located within 25 percent of length L from the distal end of the elongated member and wherein a natural frequency of the first bending mode of the elongated member and weight is at least 20 Hz.

16. The stabilizer of claim 15, wherein a natural frequency of the first bending mode of the elongated member and weight is at least 40 Hz.

17. An archery bow having at least one front stabilizer, the front stabilizer having a near end fixed to the bow, a distal free end, and a length L, the center of gravity of the front stabilizer being located within a distance D of 25 percent of the length L of the distal end of the stabilizer, wherein the stabilizer comprises an elongated member and a weight disposed on the elongated member proximate the distal end thereof, and wherein the weight has a dimension D in a direction normal to a length L of the elongated member which is at least three times a thickness T of the weight in the same direction as the length of the elongated member.

18. An archery bow having at least one front stabilizer, the front stabilizer having a near end fixed to the bow, a distal free end, and a length L, the center of gravity of the front stabilizer being located within a distance D of 25 percent of the length L of the distal end of the stabilizer, wherein the stabilizer comprises an elongated member and a weight disposed on the elongated member proximate the distal end thereof, and wherein a first mass M1, of the weight is at least 1.2 times a second mass M2 of the elongated member.

19. An archery bow having at least one front stabilizer, the front stabilizer having a near end fixed to the bow, a distal free end, and a length L, the center of gravity of the front stabilizer being located within a distance D of 25 percent of the length L of the distal end of the stabilizer, wherein a natural frequency of the first bending mode of the stabilizer is at least 20 Hz.

20. The archery bow of claim 19, where in a natural frequency of the first bending mode of the stabilizer is at least 40 Hz.

21. A stabilizer for an archery bow, the stabilizer comprising an elongated member having a near end for attachment to an archery bow and a distal end, and a weight attached to the elongated member proximate the distal end, the weight having a first mass M1 which is at least 1.2 times a second mass M2 of the elongated member, wherein the elongated member is a rod.

22. The stabilizer of claim 21, wherein the elongated member is a hollow rod.

23. The stabilizer of claim 21, wherein the weight is disk shaped.

24. An archery bow having at least one front stabilizer attached thereto, the front stabilizer comprising an elongated member having a near end for attachment to an archery bow, a distal end, and a weight attached to the elongated member proximate the distal end, the weight having a first mass M1 which is at least 1.2 times a second mass M2 of the elongated member, wherein the front stabilizer has a natural frequency of the first bending mode of at least 20 Hz.

25. The archery bow of claim 24, wherein the natural frequency of the first bending mode is at least 40 Hz.

* * * * *